US006409589B1

(12) United States Patent
Laconico, Jr. et al.

(10) Patent No.: US 6,409,589 B1
(45) Date of Patent: Jun. 25, 2002

(54) COIN RETRIEVAL SYSTEM

(75) Inventors: Ramon A. Laconico, Jr., 875 Plaza Dr., San Jose, CA (US) 95125; Joseph L. Trujillo, Los Banos, CA (US)

(73) Assignee: Ramon A. Laconico, Jr., San Jose, CA (US)

( * ) Notice: Subject to any disclaimer, the term of this patent is extended or adjusted under 35 U.S.C. 154(b) by 0 days.

(21) Appl. No.: 09/559,496

(22) Filed: Apr. 27, 2000

Related U.S. Application Data

(60) Provisional application No. 60/136,504, filed on May 28, 1999.

(51) Int. Cl.[7] ..... G07F 9/06
(52) U.S. Cl. ..... 453/17; 194/350
(58) Field of Search ..... 453/16, 17; 194/350; 232/15, 43.2

(56) References Cited

U.S. PATENT DOCUMENTS

| | | | | | |
|---|---|---|---|---|---|
| 4,374,529 | A | * | 2/1983 | Kobayashi et al. | 453/17 |
| 5,016,745 | A | * | 5/1991 | Schoeb et al. | 453/17 X |
| 5,873,446 | A | * | 2/1999 | Wei | 194/350 |
| 5,913,399 | A | * | 6/1999 | Takemoto et al. | 453/17 X |
| 5,941,364 | A | * | 8/1999 | Wei | 194/350 |
| 6,082,519 | A | * | 7/2000 | Martin et al. | 194/350 |

* cited by examiner

*Primary Examiner*—James R. Bidwell
(74) *Attorney, Agent, or Firm*—Howard E. Lebowitz

(57) ABSTRACT

A coin retrieval system for coin operated machines, such as slot machines, which comprises a drop bucket containing a self closing lock which is held open while the drop bucket is in the machine but springs closed when the drop bucket is removed. The bucket contains a full opening bottom. The system contains a system for weighing and emptying the drop bucket.

20 Claims, 12 Drawing Sheets

(COVER NOT SHOWN)

COIN RETRIEVAL SYSTEM

This application claims the benefit of U.S. Provisional Application 60/136,504 filed May 25, 1999, which is hereby incorporated herein by reference.

BACKGROUND OF THE INVENTION

1. Field of the Invention

The field of the invention is coin retrieval system for a coin or token operated device.

2. Description of the Prior Art

There are a large variety of coin operated devices in use. These devices all have containers where the coins accumulate. In many cases the container is of a removable type, and security against pilferage is a concern.

One particular example is the slot machine. Slot machines are a very popular form of legal gambling throughout the world. In a slot machine coins are diverted to a dump bucket located within a locked enclosure in the slot machine when a coin hopper is full. The buckets are collected at regular intervals depending on the season. When the time comes to empty the bucket an employee typically inserts an identification card into a card reader and unlocks the enclosure. The employee then manually removes the open bucket and places a paper containing the slot machine number into the open bucket. The employee then replaces an empty bucket into the empty container and locks the enclosure. The open bucket is then lifted onto a cart that is pulled by a mechanical puller. This step is then repeated until the cart is full. A full cart is delivered to a coin counting room. Each bucket is weighed on a scale and the weight is converted to a monetary value based on the weight of the particular coin. The monetary take is correlated to the slot machine based on the identifying paper which the employee placed in the cart when the full bucket was removed from the container.

The current procedure is inefficient in several ways. First, the buckets need to be harvested according to a schedule, rather than when they are nearly full. Thus sometimes a bucket may either overfill or be harvested when not nearly full. Second, the process of removing and handling the buckets is awkward and labor intensive. A bucket needs to be lifted out of the slot machine enclosure and onto a cart and then again lifted from the cart to a weigh scale. Finally, there is a security problem in that the open buckets full of money must be guarded and secured from pilferage.

The security issue with the current procedure is well recognized in the industry and results in inefficient use of labor in harvesting the drop bucket. The Nevada Gaming Control Board, which is a recognized leader in gaming control, set internal control standards for Group I and Group II licensees (Nov. 27, 1996) as follows:

Coin Drop Standards

1. A minimum of three employees (two for Group II licensees) are involved in the removal of the slot drop, at least one of whom is independent of the slot department.
2. Security is provided over the buckets removed from the slot drop cabinets prior to being transported to the count room.
3. If more than one trip is required to remove the slot drop from all the machines the filled carts of coins are either locked in the count room or secured in another equivalent manner.

There is a need for a labor efficient and secure system for retrieving coins from coin operated devices.

There is a need for an improved labor efficient system for harvesting the slot drop from slot machines.

There is a need for a secure system for harvesting the coin drop from slot machines.

SUMMARY OF THE INVENTION

The present invention is directed to a coin retrieval system for coin or token operated devices. One embodiment is directed to harvesting the slot drop from slot machines in an efficient and secure manner. In a version of the invention each slot machine is equipped with a device comprising an engagement rod pusher, with a base attached to the slot machine and one or more rods extending out from the base, and a coin drop bucket having a top cover which includes a self-closing seal. The seal includes an enclosure with an aperture extending through it and a horizontal closure plate located within the enclosure which is attached to the enclosure by springs so that the closure plate covers the aperture when the springs are relaxed and the plate can be pushed into a second position where the aperture is open when the springs are extended. The enclosure includes an end plate on the end closest to the with openings to located to accept the rods from the rod pusher. When the drop bucket is positioned in the slot machine, the cover engages the rod pusher, the rods push the closure plate away from aperture, opening the aperture for coins to flow into the coin drop bucket. When the drop bucket is removed so that the cover no longer engages the rod pusher, the closure plate springs back closing off the aperture in the cover.

The seal can be refined to include rails within the enclosure providing surfaces for the closure plate to slide back and forth. The plate can also have a slot running perpendicular to the direction of motion of the plate which is locked into place by a lock assembly with a lip which is sized to fit in the slot. The lock assembly is attached within the enclosure on springs so that it moves vertically such that the lip engages the slot and locks the closure plate in place when the cover is not engaging the rod pusher, but the lock is pushed down by the rods when the cover engages the rod pusher and the closure plate is free to move.

The coin drop bucket can also be equipped with a sliding bottom mounted on rails which can be quickly opened to empty the drop bucket. The bottom has a slot on its underside and a flap door mounted on springs which holds the sliding bottom in place.

The device can also include a detector mounted within the slot machine to detect when a drop bucket is full and report an alarm at a central location indicating that the drop bucket requires harvesting.

The system can also include a transfer cart to facilitate removal of the drop buckets from the machine. The top of the cart has a flat horizontal surface which can accept a group of drop buckets, the top surface has roller rails which allow the drop buckets to be pushed onto the cart. The top surface is mounted on a jack having two positions, a lower position at the level of the drop bucket and an upper position.

The system can also include a processing cart. The processing cart has an upper flat surface located at the level of the upper position of the transfer cart, having a turntable surrounded by two roller rails spaced to accept a drop bucket on the turntable, having a first and second position. Under the turntable is a weigh scale which can be raised into a position where it allows the drop bucket to be weighed. The processing cart also includes a station for dumping the drop bucket. This station includes a sliding plate aligned with the second position of the turntable. The sliding plate has a tongue located to engage the slot on the bottom of a drop bucket, and a stop designed to open the flap door in the drop bucket when a drop bucket is loaded on the dumping station and pushed against the stop. The sliding plate is attached to a positioner, located under the sliding plate, which will move the plate allowing a drop bucket located on the dumping station to empty into a coin container which is located under the sliding plate.

An object of the invention is to provide a system for efficient harvesting of the coin drop from coin operated machines and slot machines.

A further object of the invention is to provide a system for harvesting the coin drop from coin operated and slot machines which resists pilferage of the coins.

A further object of the invention is to provide a removable coin retrieval device for coin operated machines and slot machines which is open to receive coins when mounted in the machine and automatically locks when removed.

BRIEF DESCRIPTION OF THE DRAWINGS

These and other features, aspects and advantages of the present invention will become better understood with regard to the following description, appended claims and accompanying drawings, where:

DESCRIPTION OF THE PREFERRED EMBODIMENTS

Figure 1:
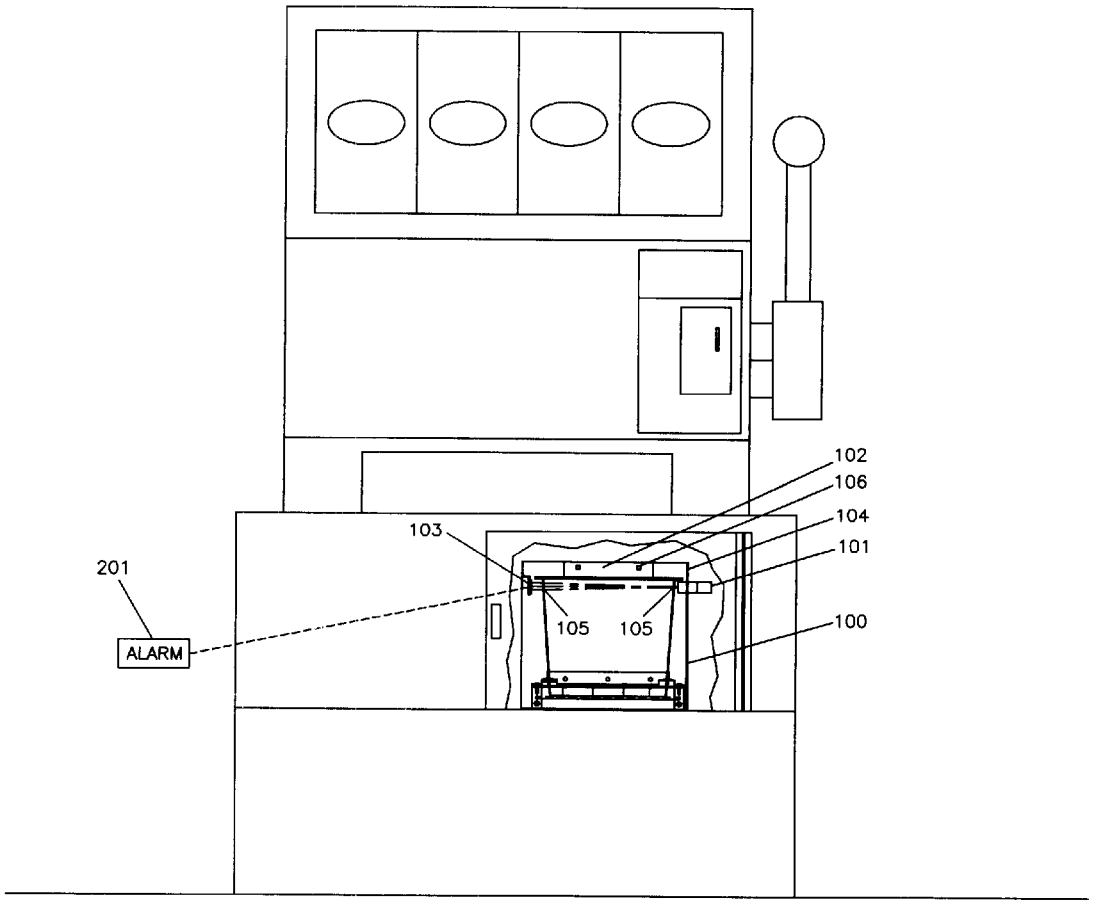
FIG. 1 is a front view of a drop bucket in the slot machine.

A preferred version of the invention is shown in the figures and relates to a system directed to removal of the slot drop from slot machines. FIG. 1 shows a drop bucket 100 mounted in a slot machine. The self-closing seal 102 of the cover 104 is shown engaged with the engagement rod pusher 106. An light source 101, optical sensor 103, are shown passing through holes 105 and operating an alarm 201 are shown as a means to detect when the drop bucket is filled to the level corresponding to the source and sensor.

Figure 2:
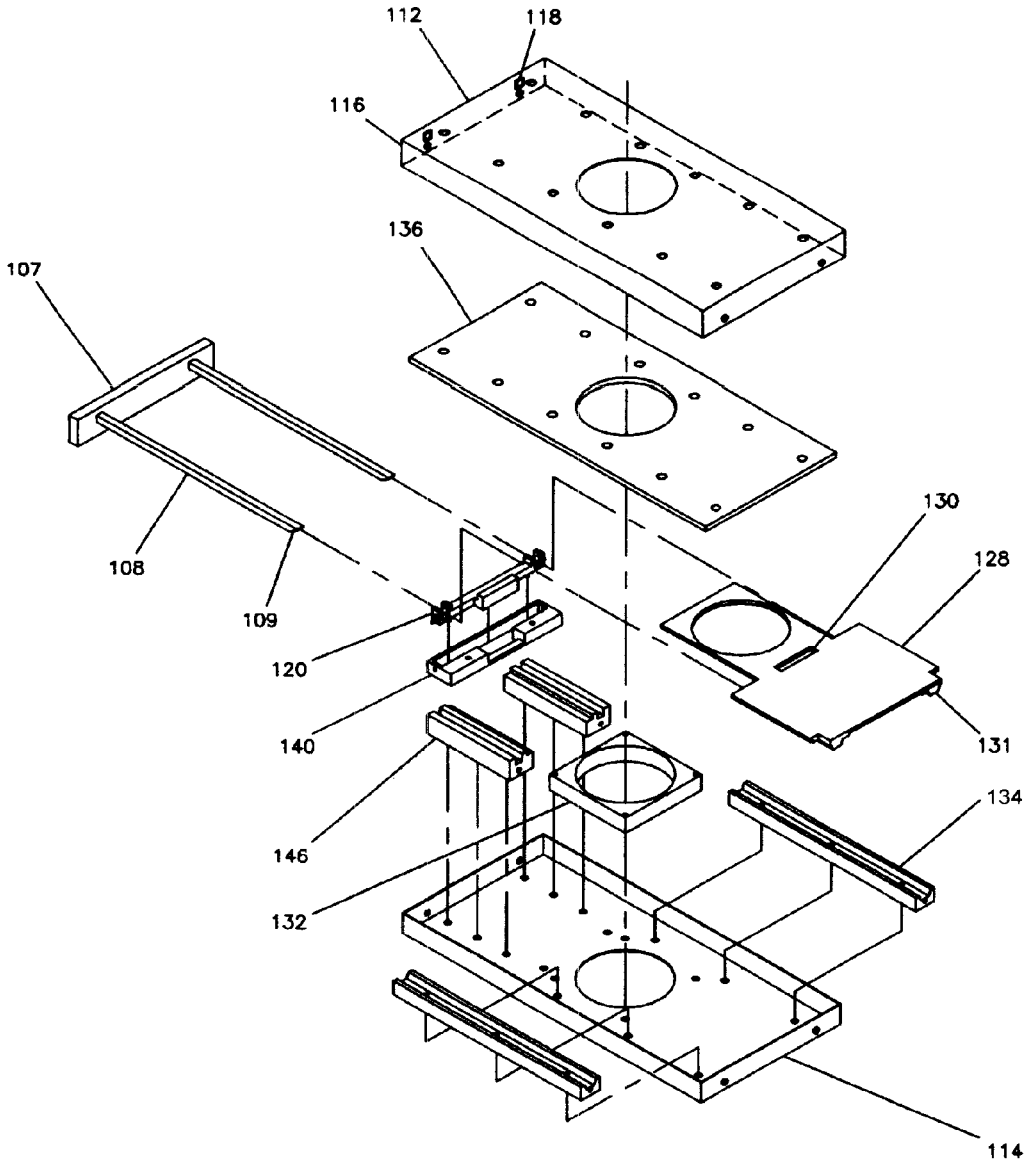
FIG. 2 is an exploded view of the self-closing seal.
Figure 3A:
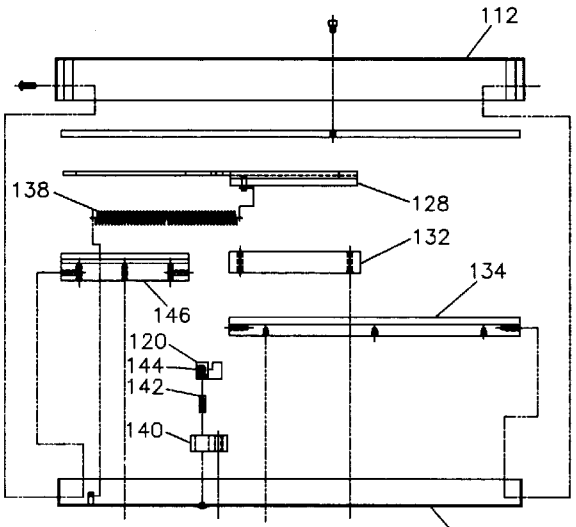
FIG. 3A is an assembly drawing of the self-closing seal.
Figure 3B:
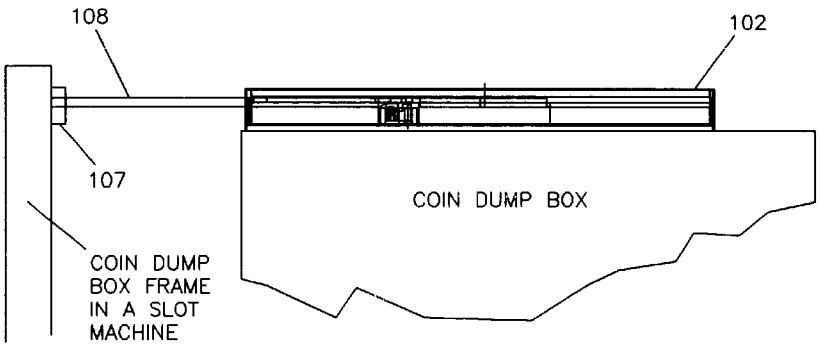
FIG. 3B is a side view showing the assembled seal engaging with the engagement rod pusher attached in a slot machine.
Figure 4A:
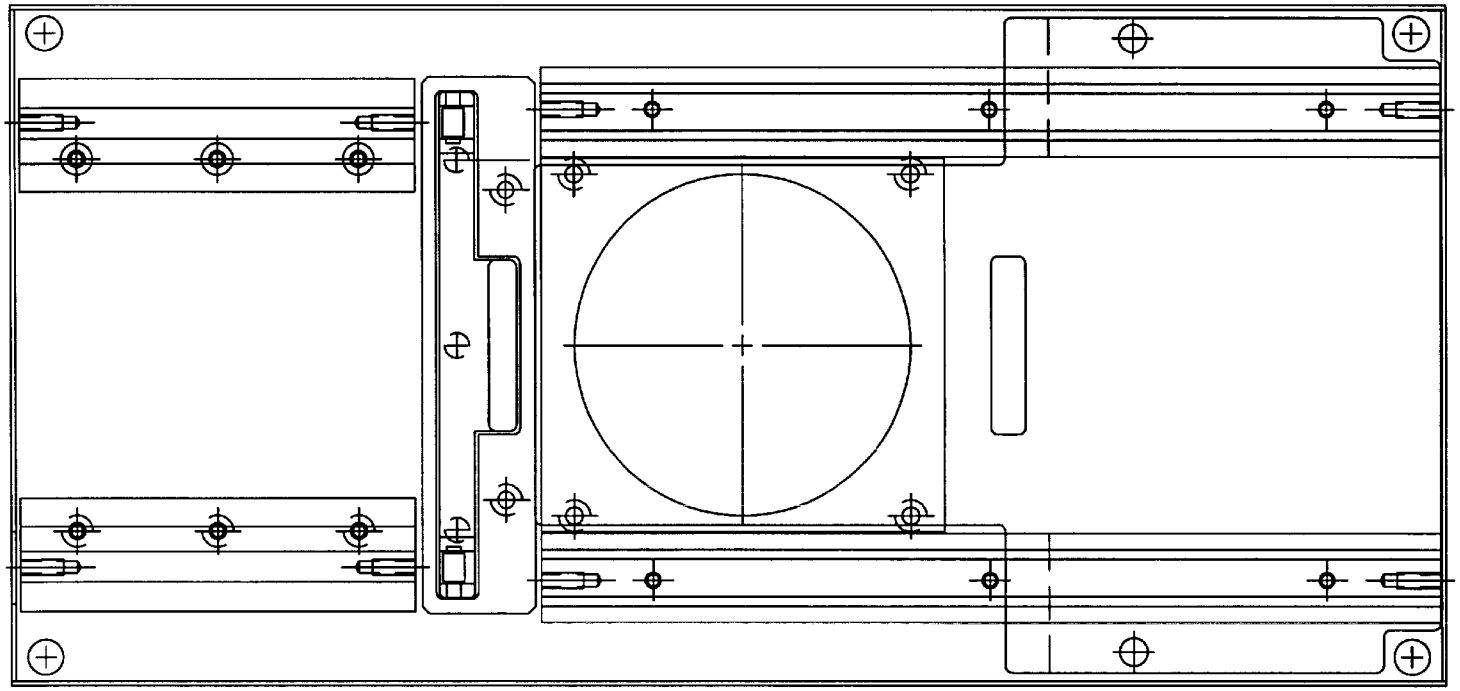
FIG. 4A is a plan view of the assembled self closing seal.
Figure 4B:
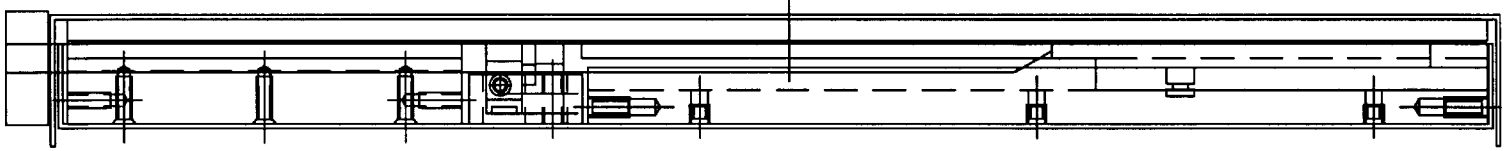
FIG. 4B is a front view of the shuttle closure plate.

FIG. 2 is an exploded view of a disassembled self-closing seal, shown without the springs and brackets for clarity. The engagement rod pusher is shown having a base 107 and two rods 108 each having a beveled section 109 at the bottom end of the rods . The enclosure has a top cover 112 and a bottom cover 114 and an end piece 116 with openings 118 through which the rods extend when the engagement rod pusher is engaged with the self-closing seal. The lock mechanism 120 is shown with a lip 122, rollers 124 and end plates 126 (the rollers and plates are shown in FIGS. 6B and 6C). The shuttle closure plate 128 is shown having a slot 130 and lugs 131. The lock mechanism fits in front of the closure plate with the lip 122 engaged in the slot when the closure plate and slot are in their relaxed positions, with the lock plate covering the aperture of the cylinder 132. The shuttle closure plate is constrained to move back and forth on a horizontal plane by two guide rails 134 one on either side of the enclosure, each having a slot in which the lugs ride. The guide rails are attached to the bottom cover. The shuttle plate is also retained by a top spacer plate 136 attached to the top cover. Moving to FIG. 3A, which is an assembly drawing of the self-closing seal, it will be seen that the shuttle plate is motivated by a pair of shuttle springs 138 attached to the bottom cover on the front end and to the bottom of the shuttle plate on the other end. The lock mechanism 120 is guided to move up and down within a lock base 140 attached to the bottom cover in front of the guide rails. The lock mechanism is motivated by three lock springs 142 which attached to the lock base at one end and to the lock mechanism in a spring chamber 144 in the front of the lock mechanism. The rods of the engagement rod pusher are guided between vertical and horizontal surfaces in two rod guide rails 146 one on either side of the enclosure attached to the bottom cover in front of the lock base. The opening in the rod guide rails is sized to guide the rods to the ends of the shuttle plate. FIGS. 4A and 4B show the assembled seal.

Figure 5A:
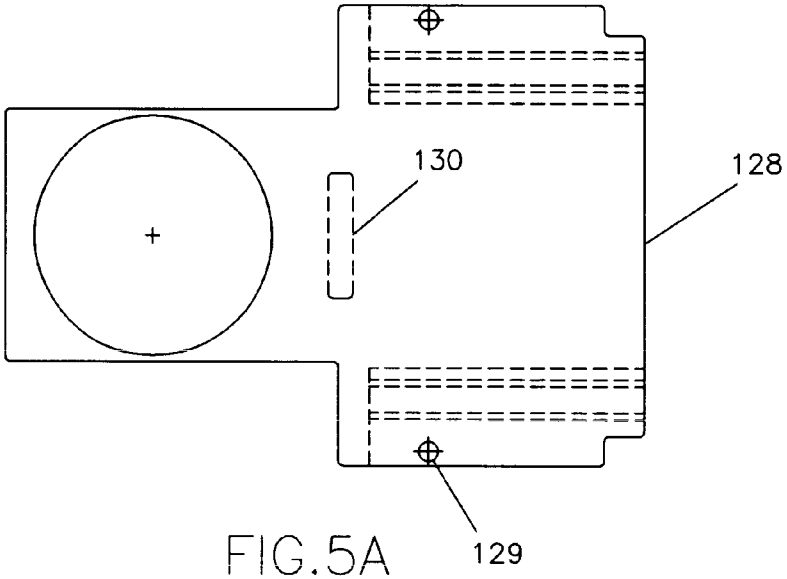
FIG. 5A is a plan view of the shuttle closure plate.
Figure 5B:
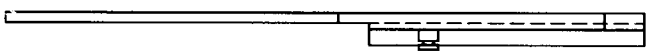
FIG. 5B is a front view of the shuttle closure plate.
Figure 5C:
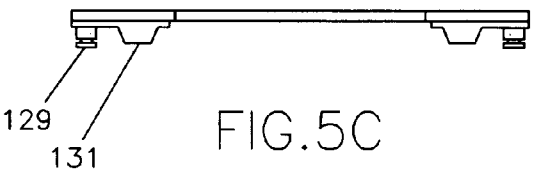
FIG. 5C is a side view if the shuttle closure plate.

FIGS. 5A, 5B, and 5C show the shuttle closure, with plate 128, slot 130, lugs 131 and attachment point 129 for attaching the shuttle springs.

Figure 6A:
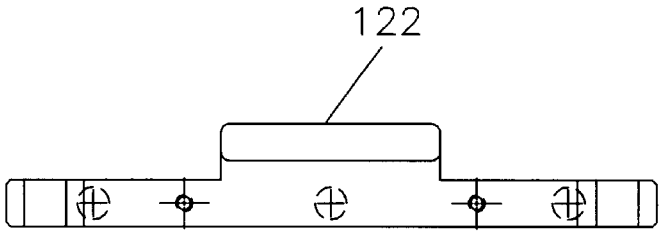
FIG. 6A is a plan view of the lock mechanism.
Figure 6B:
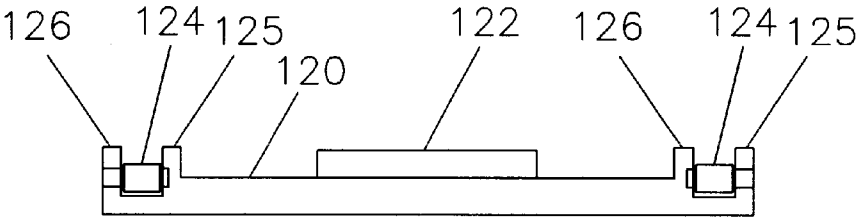
FIG. 6B is a front view of the lock mechanism.
Figure 6C:
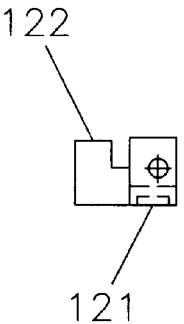
FIG. 6C is a side view of the lock mechanism.

FIGS. 6A, 6B, and 6C show the lock mechanism 120, having a lip 122, and roller bearings 124. The roller bearings are held between tabs 125 and end plates 126.

Figure 7A:
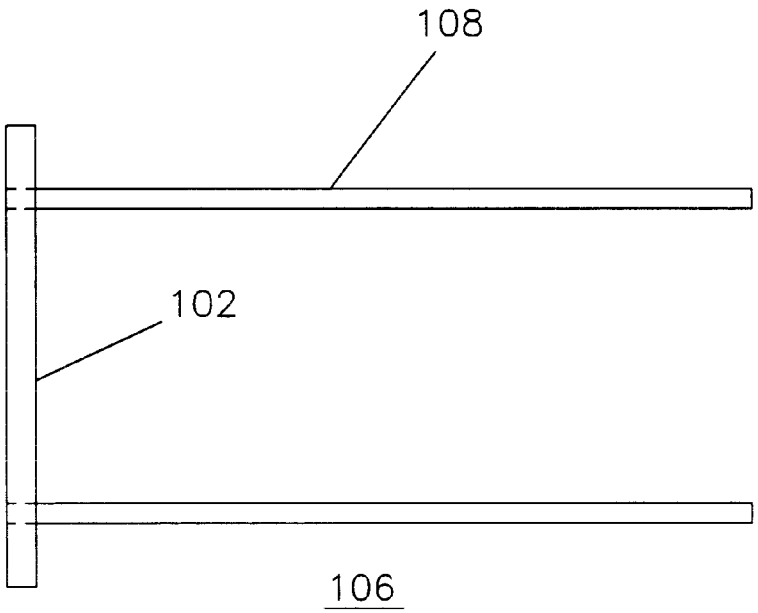
FIG. 7A is a plan view of the engagement rod pusher.
Figure 7B:
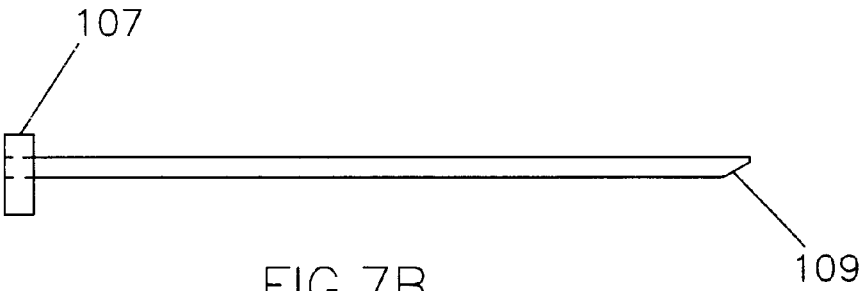
FIG. 7B is a front view of the engagement rod pusher.
Figure 7C:
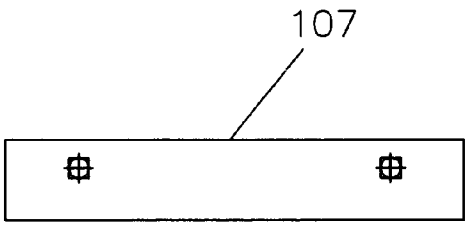
FIG. 7C is a side view of the engagement rod pusher.

FIGS. 7A, 7B, 7C shows the engagement rod pusher 106, having a base 107, rods 108 and a beveled section 109 at the bottom of the ends of the rods.

Figure 8:
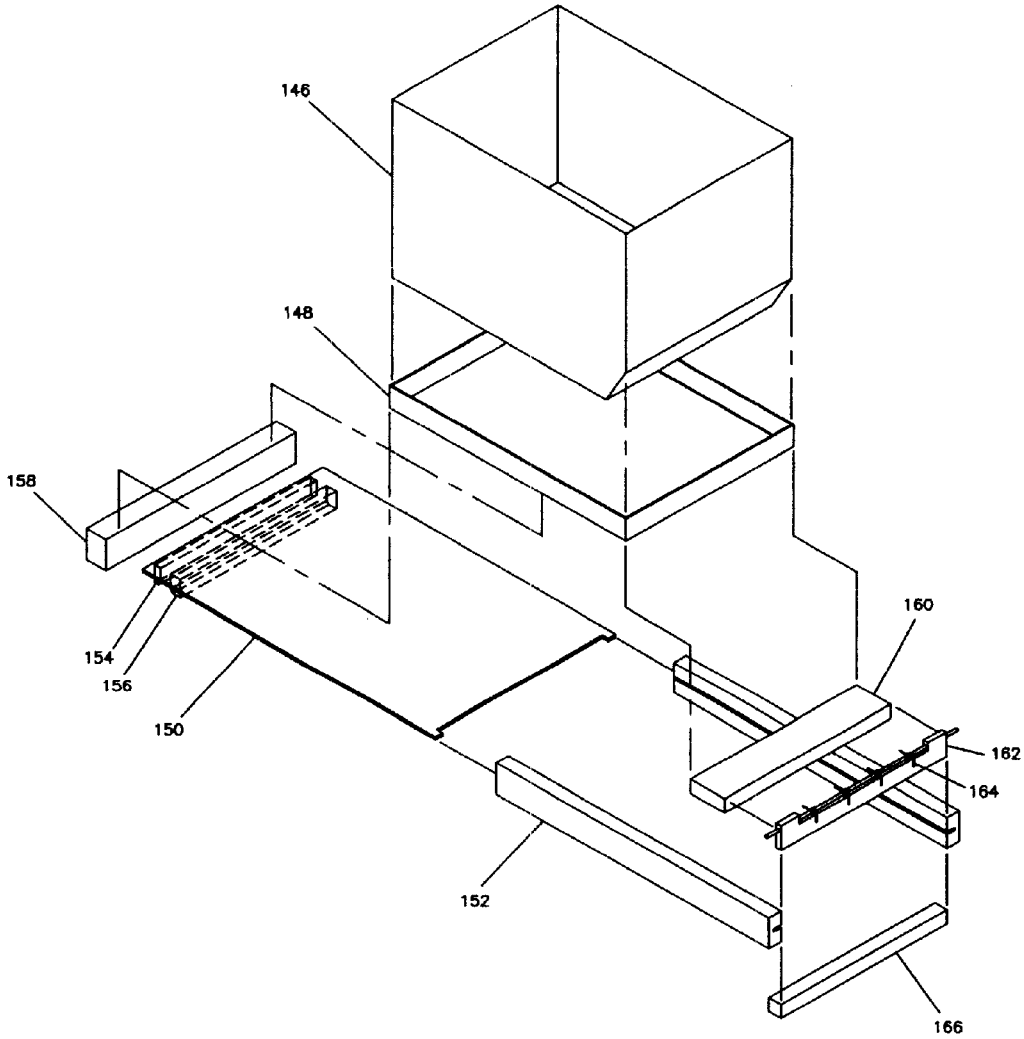
FIG. 8 is a exploded view of the bottom of a drop bucket.

FIG. 8 is an exploded view of the drop bucket without the cover, showing the container 146, and the bottom mechanism. The bottom mechanism is attached to the bottom of the container by a collar 148. The bottom plate 150, is held between two grooved side rails 152. The bottom plate has a groove 154 formed between two ribs 156 on its underside. An end block 158 blocks the motion of the plate. A second end block 160 sits above the side rails. An end flap 162 is attached to the second end block by four end flap springs 164. The end flap has two ledges 163 which extend above the second end block. A bottom stop block 166 is attached to the side rails below the end flap.

Figure 9A:
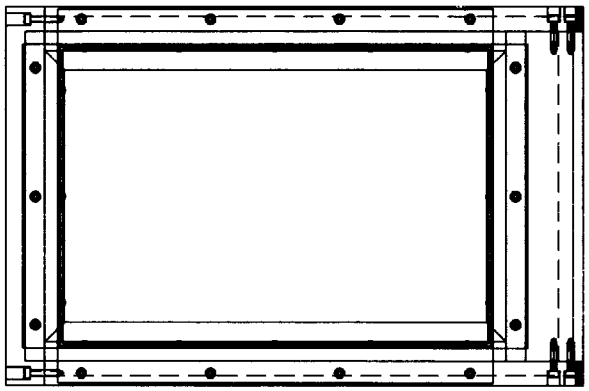
FIG. 9A is a plan view of the drop bucket.
Figure 9C:
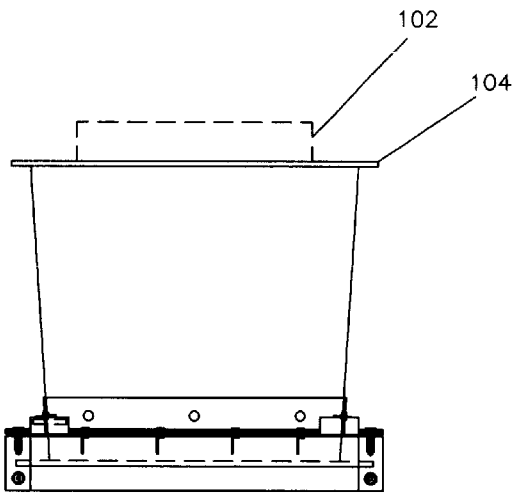
FIG. 9C is a side view of the drop bucket.
Figure 9B:
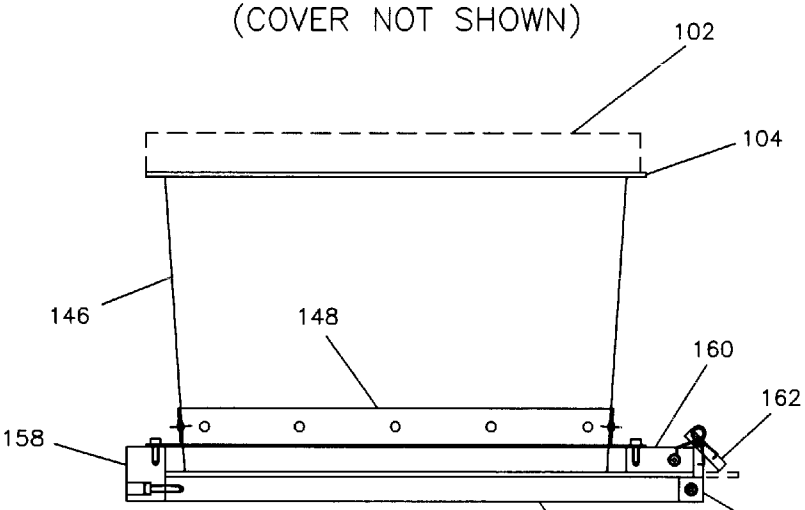
FIG. 9B is a front view of the drop bucket.

FIGS. 9A, 9B, and 9C show plan, front and side views of the drop bucket.

Figures 10A, 10B, 10C:
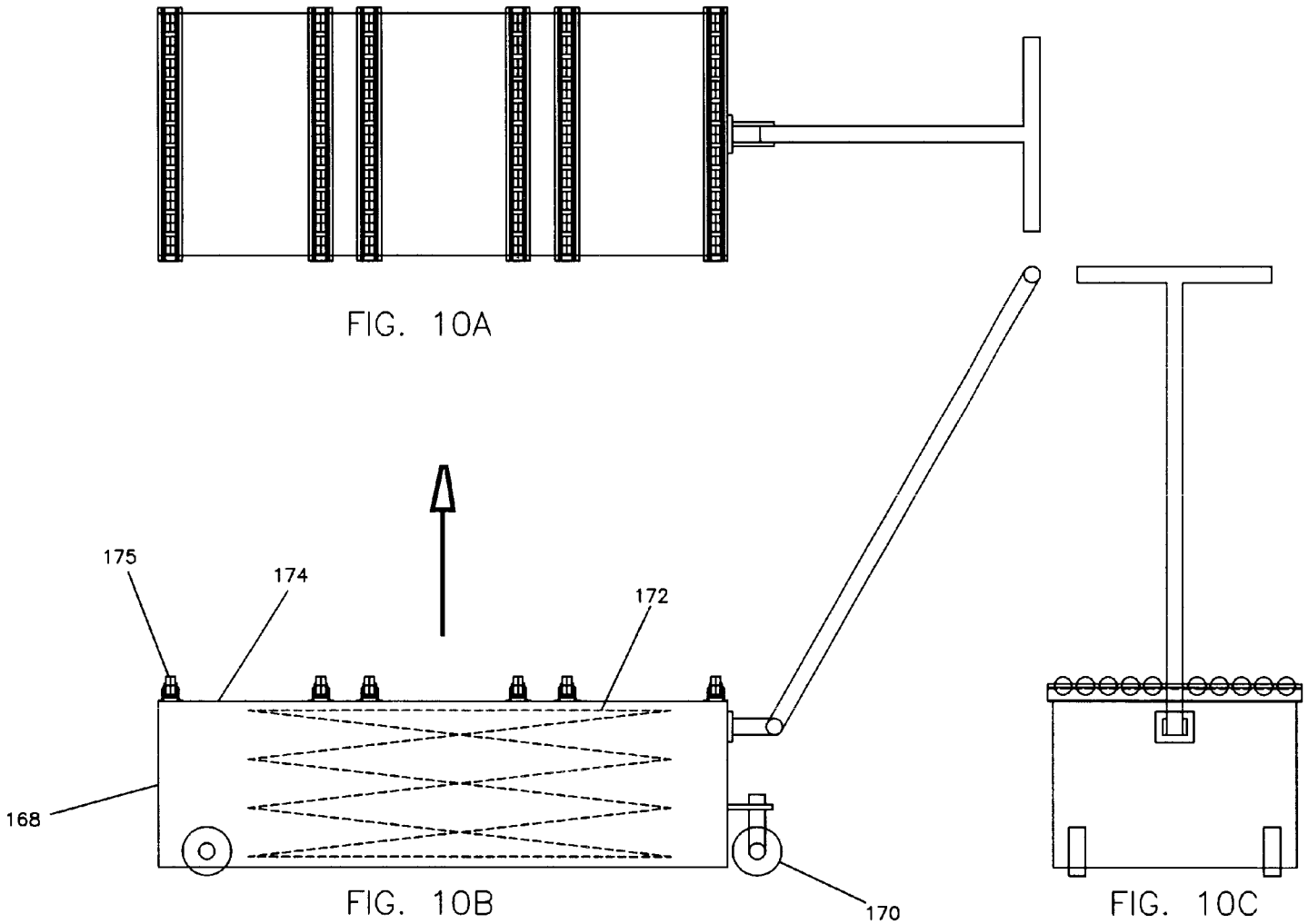
FIG. 10A is a plan view of the collection cart.
FIG. 10B is a front view of the collection cart.
FIG. 10C is a side view of the collection cart.

FIGS. 10A, 10B, and 10C show the collection cart. The collection cart comprises a frame 168 with wheels 170 and ajack 172. A flat horizontal surface 174 is attached to the top of the jack. The car is sized to hold three drop buckets. There are two conveyor rails 175 for each drop bucket location. The jack has two positions a lower position and an upper position. The lower position is at the height corresponding to the bottom of a drop bucket in the coin drop cabinet of the slot machine, so that a drop bucket may be readily pulled out onto the conveyor rails.

Figure 11A:
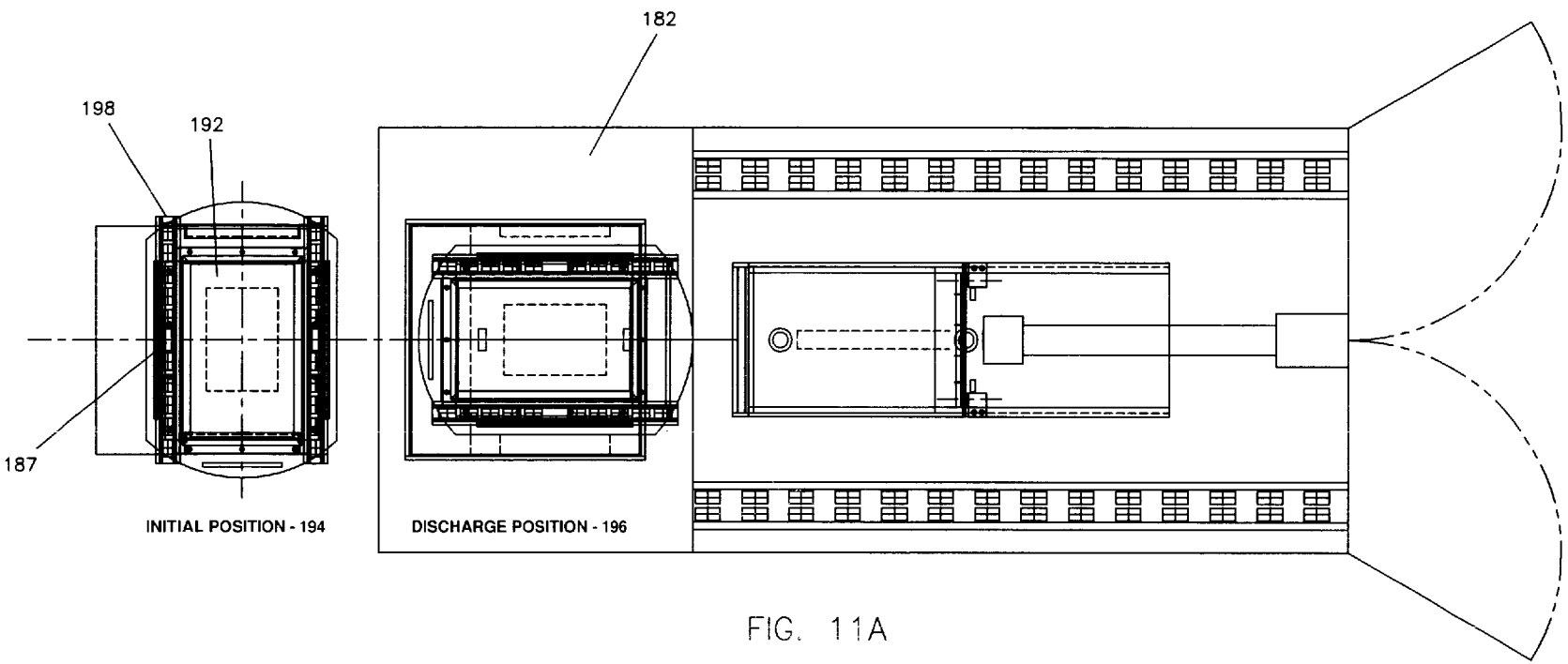
FIG. 11A is a top view of the process cart.
Figure 11B:
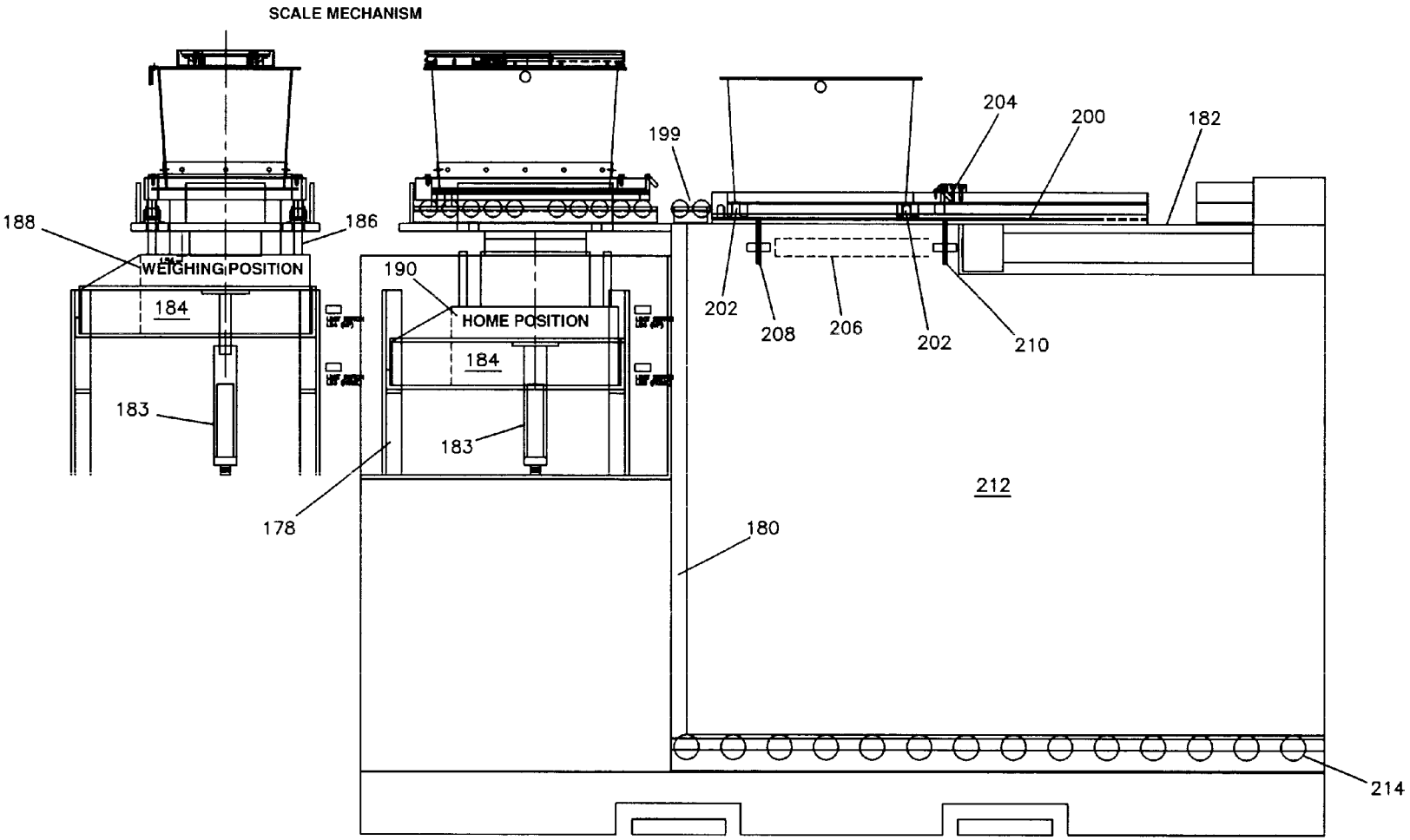
FIG. 11B is a front view of the process cart.

FIG. 11A and 11B show plan and front views of the process cart 176. The process cart has two stations, one for unloading and weighing drop buckets and a second for dumping the contents of the cart. The cart shown comprises a cabinet with a first compartment 178 and a second compartment 180. The cabinet has an upper flat surface 182. The upper flat surface is at the same height as the upper position of the jack on the collection cart. Inside the first compartment is a weigh scale 184 support beams 186. The scale is supported on a lift mechanism 183, which lifts the scale into an upper position 188 and a lower position 190. On top of the upper surface is a turntable 192 shown in a first position 194 and a second position 196. When the scale is in the upper position and the turntable is in the first position, the scale supports the weight of the drop bucket on the support beams 186 through openings 187 in the top surface. The turntable has conveyor rails 198 to facilitate pushing a drop bucket from the collection cart onto the process cart when the turntable is in the first position.

The second station on the cart contains additional conveyor rails 199 aligned with rails on the turntable when the turntable is in the second position. The rails lead to a sliding plate 200 in the upper flat surface above the second compartment of the cabinet. The sliding plate has a tongue 202 which is located and sized to fit snugly into the groove on the underside of the bottom plate of a drop bucket when the drop bucket is pushed over the rails onto the sliding plate and against the stop 204. The sliding plate is connected to a positioner 206 which is located in the second compartment. The stop is positioned so that it strikes with the ledge on the end flap of the bottom of a drop bucket and opens the flap when the drop bucket is pushed against the stop allowing the bottom plate of the drop bucket to be opened. FIG. 11B shows a drop bucket on the sliding plate against the stop with the end flap open. The sliding plate is shown in a first position 208 where the positioner is extended and the sliding plate and bottom plate of the drop bucket are closed, and a second position 210 where the positioner is retracted and the sliding plate and bottom plate are open. There is a coin receiver vessel 212 in the second compartment shown on wheels 214.

A drop bucket of this invention may preferably be adapted from an existing drop bucket from a slot machine by attaching a cover plate to the top of the bucket and attaching a self-closing seal to the cover. The self-closing seal is located so that the aperture in the seal will be aligned with the coin output from the slot machine which generally outputs through a funnel shaped conduit. A preferable material for the cover and self closing seal is aluminum, though other sturdy materials such as steel are certainly acceptable. The self-closing lock assembly is preferably bolted to cover plate and the cover plate is preferably bolted to the drop bucket container portion, though other methods appropriate to the material of construction such as riveting, welding, soldering or brazing can also be employed. The components of the seat itself are preferably attached to the enclosure by screws.

The bottom assembly is preferably made of aluminum but could also be made of other materials such as steel. The bottom assembly is preferably adapted to an existing drop bucket by removing the fixed bottom on the existing bucket and attaching the bottom assembly to the container section by a collar. The collar is preferably riveted to the container section, but could be bolted, brazed or welded as appropriate for the materials. Aluminum is a preferred material though other materials such as steel are acceptable. The end blocks of the bottom assembly are preferably bolted to the bracket, the side rails are preferably bolted to the bottom end block and stop block, though it will be obvious that the components can be attached in a variety of ways.

The drop bucket has been described as being adapted to an existing drop bucket from a slot machine however another embodiment is to fashion the entire drop bucket as a single unit rather than adapting the new components to an existing unit. In this case the forms of attachment may be different than described in the preferred embodiment. For instance items may be welded or soldered rather than screwed or riveted. Also, items which are described as attached may be two sections of a single piece of material.

The drop bucket may have holes drilled in it which will align with the light source and optical sensor to operate the alarm when the coin level reaches the height of the holes. It will be obvious that other than optical devices may also comprise a means for detecting when the coin level has reached the desired height. Such devices may use electrical resistance or sound or electromagnetic energy outside of the range of visible light or other level sensing devices which are known to those skilled in the art.

The engagement rod pusher is preferably made of stainless steel. The base is attached, preferably bolted, to the coin drop cabinet of the slot machine so that it will mate with the self-closing lock when the drop bucket is in place under the coin drop conduit. When the drop bucket is in position and the self-closing lock is engaged with the rods in the engagement rod pusher, as the rods are inserted through the holes in the end piece of the enclosure the beveled portion of the rods meets the rollers of the lock mechanism arid pushes the lock mechanism down so that the lip in the lock mechanism passes under the shuttle closure plate allowing the plate to move when the rods push on the plate, until the shuttle closure plate is in the position where the aperture in the lock is unobstructed. When the rods disengage from the self-closing lock the shuttle closure springs back and covers the aperture and the lock mechanism is pushed up by its springs and the lip of the lock mechanism fits into the slot on the shuttle closure plate immobilizing the shuttle closure.

The collection cart is made from a commercially available jack device such as a gas cylinder lift that can operate between two heights. The jack is mounted on a frame with wheels and has a top surface attached to the top of the jack with pairs of conveyor rails to slide the drop buckets onto. A preferred type of conveyor comprises a series of wheels and is known as a snap in wheel rail. The jack is set to operate between two heights, one corresponding to the position of the bottom of the drop bucket in the slot machine and the other corresponding to the height of the process cart.

The process cart contains two stations, a means for receiving and weighing drop buckets and means for dumping drop buckets. The process cart is a cabinet including two compartments and a top flat surface. The first station is for receiving and weighing drop buckets. This station includes a scale mounted on a lift mechanism, in the first cabinet. The scale is a scale capable of weighing a drop bucket to within an accuracy of one coin which can transmit the weight digitally, such as a Metier Toledo Coin Counting Scale Model 8582-2006. The lift mechanism operates between an upper and lower position. The lift mechanism is electrically motor operated to switchably move between the upper and lower position. On the top flat surface above the scale is a turntable, which is a commercially available turntable having two positions a first position and a second position which is 900 rotated from the first position. The turntable may be motor operated to switchably move between the two positions. The turntable has conveyor rails to align with the rails on the collection cart when the turntable is in the first position. The turntable base is attached to the top of the process cart and has four openings through which the weight of the bucket is supported by a pedestals attached to the scale which extend through the openings when the turntable is in the first position and the scale mechanism is in the upper position.

The second station is a means for dumping the drop buckets. Additional conveyor rails align with the rails on the turntable and lead to a sliding plate in the upper flat surface of the processing cart. The sliding plate has a tongue which is sized and located to engage the groove in the underside of the bottom plate of the drop buckets when the drop bucket is on the sliding plate. The second station also includes a stop located just beyond the sliding plate which is located to push the ledge on the end flap and open the flap on the bottom of a drop bucket when the drop bucket is pushed fully against the stop. The sliding plate is connected to a positioner which is a piston operated by a motor controlled by a switch. The positioner is located under the sliding plate in the second compartment of the cart. The positioner moves the sliding plate and the bottom of a drop bucket with which it is engaged between an open and closed position. A coin receiver vessel is located in the second compartment.

In a preferred embodiment the process cart has a scanner or reader, such as a bar code reader, to read a bucket number which is typically encoded on each bucket. A preferred embodiment also has sensors to determine the position of the turntable, whether there is a drop bucket on the turntable the position of the scale, and the position of the sliding plate and its positioner. A preferred embodiment still further has a computer which is functionally connected to each sensor and the switches for operating the turntable, the scale, and the positioner, as well as to the output from the scanner or reader and the output from the scale. The computer would include programming which would automatically operate the scale and record the scanned cart number and weight of the drop bucket. A preferred embodiment includes a personal identification device such as a finger print reader or other device for identified the operator. A card reader and personal identification card or an input key pad for inputting an identification number could also be used as could any of a number of alternatives which would be known to those skilled in the art. The personal identification device is preferably connected to the computer device which contains a data base of authorized users and appropriate programming for comparing the inputted value to the data base. The computer would be programmed to confine use of the cart to authorized users. A preferred embodiment of the invention has provision for operation of the device automatically under control of the computer or manually through operation of the control switches.

It will be obvious that many variations of the invention are possible. An engagement means may be an engagement rod pusher as previously described or can include similar devices which would be obvious to those skilled in the art which are attached to the machine structure and which can engage with a means for automatic closure on the cover of a drop bucket to hold the closure in the open position when the engagement means is engaged with the automatic closure means and allows the closure to automatically close when the drop bucket and closure means are withdrawn. A means for automatic closure of the aperture is a device, such as the self-closing seal previously described, which has a member, such as a plate, which covers the aperture in the cover when it is not pushed out of the way by the engagement means. Suitable closure means include spring loaded plates as in the self-closing seal as well as accordion type structures where the closure is itself a spring which is pushed away from the closure means by the engagement means and springs back to cover the aperture when the cover is disengaged from the engagement means. The closure means may include an enclosure or it may be directly attached to the cover. For example the closure means could be attached to the bottom of the cover and the engagement means could extend through openings in the container section.

The means for fully opening the bottom of a drop bucket may be a slidable bottom such as described in the previous embodiment or similar structures which would be obvious. Another suitable structure would be a bottom plate attached to a container by hinges and held closed by a latch. A critical requirement is that the fully opening means must essentially completely open the bottom cross section of the drop bucket so that the coins may fully discharge.

The means for transporting drop buckets is a cart on wheels which holds one or more drop buckets. The collection cart previously described is a suitable transporting means.

The processing station comprises a means for receiving and weighing drop buckets and a means for dumping drop buckets. A receiving and weighing means includes a platform for receiving the drop bucket such as a turntable, mounted over an accurate scale which can weigh a drop bucket to within an accuracy of the weight of one coin. A suitable receiving and weighing means is the first station of the processing cart as previously described.

The means for dumping a drop bucket includes a device which engages with the rapidly opening means of the drop bucket bottom so as to open the bottom completely and allow the coins in a drop bucket to completely discharge into a coin receiving vessel. A suitable dumping means is the second station of the processing cart as previously described.

The system is operated as follows:

A signal is received from the means for detecting that a drop bucket is full to the desired level. The collection cart is taken to the designated slot machine area. An employee scans the slot machine number on a hand held scanning device. The employee then opens the door to the drop bucket cabinet and scans the number on the drop bucket. The drop bucket is then pulled onto a set of conveyor rails on a collection cart. When the drop bucket is pulled out the closure seals the aperture in the drop bucket cover. The process is repeated until the cart is full or all the machines needing processing are loaded. The collection cart is taken to the processing cart and the jack is raised to the level of the processing cart. The first drop bucket is rolled onto the turntable which is in the first position The scanner on the process cart reads the number on the drop bucket. The scale is raised into the upper position and the bucket is weighed and the weight is recorded on the computer. The turntable is rotated into the second position so that it faces the second station for dumping the drop bucket. The bucket is rolled off onto the sliding plate against the stop. The positioner is operated to open the sliding plate and the bottom plate of the drop bucket into the coin receiver vessel. The empty drop bucket is returned to the collection cart. The process is repeated until all the full drop buckets have been processed. When the coin receiver vessel is full the processing cart is taken to a coin counting room for further processing.

While the invention has been described based on the slot machine embodiment it could also be deployed in other coin operated machines such as vending machines or parking meters.

The system is an efficient and secure means for harvesting the coin drop from slot machines.

Although the present invention has been described in considerable detail with reference to certain preferred versions thereof, other versions are possible. Therefore the spirit and scope of the appended claims should not be limited to the preferred versions herein.

What is claimed is:

1. A system for removal of coins from coin operated machines, the system comprising a plurality of collection devices, one device for each machine, each device comprising:

an engagement rod pusher, comprising a base, the base permanently attached to the machine, and at least one rod, the rod being attached to the base and extending out perpendicular to the base; and a coin drop bucket, the bucket comprising, a top cover comprising a self-closing seal attached to the top cover, the seal comprising an enclosure comprising a cylinder which defines an aperture extending vertically through the enclosure, a shuttle closure comprising a plate, the plate being horizontally disposed within the enclosure, a plurality of shuttle springs disposed horizontally within the enclosure, each shuttle spring connected at one end to the enclosure and at the other end to the shuttle closure, the shuttle springs being attached such that the plate is aligned to cover the aperture when the springs are relaxed, whereby the shuttle closure can move between a first position where it covers the aperture and a second position where the aperture is not covered, an end piece attached on the end of the enclosure nearest to the first position of the shuttle, the end piece having an opening for each rod in the rod pusher, whereby when the cover engages the rod pusher, the rods extends through the openings in the end piece, and pushes the shuttle plate away from the aperture, and when the cover is pulled away from the rod pusher the shuttle plate springs back to cover the aperture;

a container section; and a bottom, the top cover is attached to the top of the container; the bottom is attached to the bottom of the container section;

the engagement rod pusher is located on the machine to engage the self-closing seal on the coin drop bucket when the drop bucket is positioned in the machine.

2. The system defined in claim 1, wherein the bottom further comprises a bottom plate slidably attached to the container section.

3. The system defined in claim 1, wherein for each device the engagement rod pusher comprises a plurality of rods; the enclosure further comprises a plurality of surfaces which confine the shuttle plate to move horizontally in a single dimension; and the end piece has a plurality of openings positioned to accept the rods.

4. The system defined in claim 3, wherein for each device the enclosure further comprises a plurality of surfaces aligned to guide the rods along a linear path to the shuttle plate when the cover engages the rod pusher.

5. The system defined in claim 4 wherein for each device, the shuttle closure plate further comprises an extension on the end first engaged by the rods, the extension having a slot shaped opening oriented perpendicular to the direction of motion of the plate; the ends of the rods further comprise a beveled section at the bottom of each rod; the seal further comprises a lock mechanism, the lock mechanism comprising, a spring chamber, a plurality of rollers attached to the top of the spring chamber, spaced to engage the rods, a lip sized to fit within the slot shaped opening, the lip being mounted above the spring chamber and behind the rollers; and a plurality of lock springs mounted vertically under the spring chamber; and the enclosure further comprises a plurality of vertical surfaces which constrain the lock mechanism to move vertically between a first position where the lip engages the slot shaped opening and a second position where the lock mechanism is below the shuttle plate; whereby when the cover is disengaged from the rod pusher the lock prevents motion of the shuttle plate and when the cover engages the rod pusher the beveled sections of the rods strike the rollers and push the plate down to the second position so that the shuttle plate is free to move.

6. The system defined in claim 5, wherein the bottom plate has a slot on its underside near one end, and wherein the bottom further comprises:

two side rails attached to opposite sides of the container at the bottom, each rail having a horizontal groove along its length, the bottom plate slidably retained between the grooves in the side rails;

a first end block attached to the end of the rails holding the slotted end of the bottom plate, blocking the motion of the bottom plate;

a second end block attached to the other end of the rails resting above the rails; and an end flap pivotally attached to the second end block by a plurality of flap springs which urge the flap to seat against the rails and block the motion of the bottom plate, the end flap comprising at least one ledge extending above the second end block.

7. The system defined in claim 6 further comprising at least one transfer cart, each transfer cart comprising:

a cart frame comprising a plurality of wheels;

a jack capable of operating between a first and second position mounted within the cart frame, the jack comprising a flat horizontal surface on its top side, the surface sized to hold at least one coin drop bucket;

a plurality of conveyor rails each rail being attached to the flat surface of the jack and positioned so that at least two rails will accommodate each coin drop bucket; wherein the first position of the jack is at a height aligned with the bottom of a drop bucket when it is in a machine; whereby a drop bucket may be rolled on to a transfer cart along the conveyor rails.

8. The system defined in claim 7 further comprising at least one processing station, each processing station comprising:

an upper flat surface;

a turntable supported on the upper. flat surface, the turntable having a first and second locked positions; and two conveyor rails attached to the turntable spaced to align with the conveyor rails on the transfer cart when the turntable is in the first position, whereby a coin drop bucket may be pushed from a transfer cart onto a process station.

9. The system defined in claim 8, wherein the upper flat surface is at the level of the second position of the jack.

10. The system defined in claim 8, wherein for each processing station the flat surface supporting the turntable and the turntable each have a plurality of openings, said openings being aligned when the turntable is in the first position; and the processing station further comprises:

a scale located below the upper flat surface;

a plurality of support beams supported by the scale and aligned with the openings in the flat surface;

a lift mechanism supporting the scale which is capable of positioning the scale between a lower position and an upper position such that when the scale is in the upper position the beams support the weight of the a drop bucket resting on the turntable, whereby the coin drop bucket thereon may be weighed.

11. The system defined in claim 10 wherein each process station further comprises:

a sliding plate, disposed over an opening in the upper flat surface, the sliding plate being aligned with the turntable when the turntable is in its second position and sized to hold a drop bucket, the sliding plate comprising a tongue located at the end nearest to the turntable, sized and positioned to fit in the slot on the coin drop bucket bottom;

a stop located on the upper flat surface at the end of the sliding plate opposite from the tongue, the stop being positioned to engage the ledge on the flap of a coin drop bucket when the bucket is positioned on the sliding plate with the flap end directed away from the turntable, whereby the flap will be opened when the drop bucket is pushed against a stop;

a positioner means located under the sliding plate, for moving the plate between a closed position and an open position; and a coin receiver vessel located below the sliding plate, whereby when a coin drop bucket is placed on the sliding plate against the stop with the tongue of the sliding plate engaged in the slot of the coin bucket bottom plate, the contents of the coin bucket is dumped into the coin receiver vessel.

12. The system defined in claim 11 wherein the process station comprises a single cabinet comprising a first and second compartments with the turntable located over the first compartment and the sliding plate located over the second compartment, and the top flat surface comprising the top of the cabinet.

13. The system defined in claim 11 wherein each device further comprises a light source and an optical sensor, both attached to the machine and an alarm device functionally connected with the sensor, and wherein each drop bucket has two holes in opposite vertical sides of the drop bucket the holes aligned to form an optical path between the light source and sensor when the drop bucket is installed in the drop bucket cabinet with the cover engaging the rod pusher, whereby the alarm device provides a signal when the drop bucket is full to a level corresponding to the position of the holes.

14. The system defined claim 11 wherein each device further comprises a means for detecting that the coin content of the drop bucket has reached a desired level.

15. A device for retrieving coins in a coin operated machine comprising:

an engagement means, permanently attached to the machine;

a coin drop bucket, the bucket comprising:

a top cover having an aperture extending through the cover, the cover comprising a means for automatic closure of the aperture when the cover is not engaged with the engagement means and automatic opening of the aperture when the cover is engaged with the engagement means;

a container section; and a full opening bottom means for opening the entire bottom cross section of the drop bucket, the top cover is attached to the top of the container; the full opening bottom is attached to the bottom of the container section.

16. A system for removal of coins from coin operated machines, the system comprising a plurality of collection devices, one device for each machine, each device comprising:

an engagement means, permanently attached to a machine;

a coin drop bucket, the coin drop bucket comprising:

a top cover having an aperture extending through the top cover, the top cover comprising a means for automatic closure of the aperture when the a top cover is not engaged with the engagement means and automatic opening of the aperture when the top cover is engaged with the engagement means;

a container section; and a bottom, wherein the bottom comprises a full opening bottom means for opening the entire bottom cross section of the coin drop bucket, whereby the coin drop bucket may completely empty; and wherein the top cover is attached to the top of the container section and the bottom is attached to the bottom of the container section.

17. The system defined in claim 16 further comprising a means for transporting drop buckets.

18. The system defined in claim 16 further comprising at least one processing station, each station comprising a means for receiving and weighing drop buckets and a means for dumping drop buckets.

19. The system defined in claim 17 further comprising at least one processing station, each station comprising a means for receiving and weighing drop buckets and a means for dumping drop buckets.

20. The system defined in claim 19 wherein each device further comprises a means for detecting that the coin content of the drop bucket has reached a desired level.

* * * * *